US005467988A

United States Patent [19]

Henwood

[11] Patent Number: 5,467,988

[45] Date of Patent: Nov. 21, 1995

[54] GOLF CLUB HEAD

[75] Inventor: William D. Henwood, Norcross, Ga.

[73] Assignee: Nicklaus Golf Equipment Company, L.C., West Palm Beach, Fla.

[21] Appl. No.: 152,439

[22] Filed: Nov. 12, 1993

Related U.S. Application Data

[63] Continuation of Ser. No. 20,065, Feb. 19, 1993, which is a continuation of Ser. No. 779,351, Oct. 18, 1991, abandoned.

[51] Int. Cl.[6] ..... A63B 53/04

[52] U.S. Cl. ..... 273/167 A; 273/172; 273/174

[58] Field of Search ..... 273/167 R, 167 A, 273/167 B, 167 C, 167 D, 167 E, 167 F, 167 G, 167 H, 169, 171, 172, 173, 174, 162 R, 164.1, 187.4, 186.2, 193 R, 194 R, 77 R; D21/214–220

[56] References Cited

U.S. PATENT DOCUMENTS

| | | | |
|---|---|---|---|
| D. 318,087 | 7/1991 | Helmstetter | D21/214 |
| 1,541,126 | 6/1925 | Dunn . | |
| 2,041,676 | 5/1936 | Gallagher | 273/77 |
| 2,756,055 | 7/1956 | Bittner | 273/171 |
| 2,954,231 | 9/1960 | MacIntyre | 273/164 |
| 3,068,011 | 12/1962 | Sano | 273/174 |
| 3,810,631 | 5/1974 | Braly | 273/167 |
| 3,841,639 | 10/1974 | Werner | 273/162 E |
| 3,955,819 | 5/1976 | Yokich | 273/164 |
| 3,997,170 | 12/1976 | Goldberg | 273/164 |
| 4,065,133 | 12/1977 | Gordos | 273/167 E |
| 4,838,555 | 6/1989 | Kobayashi | 273/167 A |
| 4,850,593 | 7/1989 | Nelson | 273/167 E |
| 5,060,949 | 10/1991 | Brill | 273/167 A |
| 5,067,715 | 11/1991 | Schmidt et al. | 273/167 F |
| 5,163,682 | 11/1992 | Schmidt et al. | 273/167 J |
| 5,257,786 | 11/1993 | Gorman | 273/167 A |

FOREIGN PATENT DOCUMENTS

| | | | |
|---|---|---|---|
| 150528 | 3/1953 | Australia . | |
| 153465 | 10/1953 | Australia . | |
| 644772 | 7/1962 | Canada . | |
| 754431 | 3/1967 | Canada . | |
| 0006733 | 9/1980 | European Pat. Off. . | |
| 244925 | 12/1925 | United Kingdom . | |
| 340579 | 1/1931 | United Kingdom . | |
| 441593 | 1/1936 | United Kingdom | 273/167 A |

OTHER PUBLICATIONS

Golf Digest, Dec., 1981, "Can Metal Woods Help Your Game".

"Golf and the Good Life", 1979.

"845s Metal Woods Will Set You Straight".

*Primary Examiner*—Sebastiano Passaniti

*Attorney, Agent, or Firm*—Fay, Sharpe, Beall, Fagan, Minnich & McKee

[57] ABSTRACT

A golf club head having improved weight distribution has an integral hollow metal body with a bottom wall including a recessed cavity inwardly of the body throughout an extended area which lies rearwardly of the front striking face and inwardly of the heel and toe such that the ground engaging sole area of the head comprises a front rail portion adjacent the front striking face and side rail portions joined to the front rail portion and extending toward the rear wall adjacent the heel and the toe. The recessed cavity has a size and depth sufficient to result in a concentration of club head weight in the heel and toe areas and to produce an elevation in the center of gravity of the head relative to the ground engaging sole area.

6 Claims, 2 Drawing Sheets

GOLF CLUB HEAD

This is a continuation of application Ser. No. 08/020,065 filed Feb. 19, 1993, which in turn is a continuation of application Ser. No. 07/779,351 filed Oct. 18, 1991, now abandoned.

BACKGROUND OF THE INVENTION

The subject invention is directed to an improved golf club head construction.

The invention is especially suited for incorporation in a cast metal golf head and will be described with particular reference thereto; however, heads embodying the invention could be formed using many known techniques.

Currently, many golf club heads of the "wood" category are manufactured from metal using investment casting techniques. These club heads are generally hollow shells with perimeter weighting. That is, the weight of the head is concentrated in the outer peripheral shell surface.

Although perimeter weighting has resulted in improvement in club performance as compared to earlier solid body club designs, it is believed that even further performance improvements can result from more desirable club head weight distribution.

SUMMARY OF THE INVENTION

The subject invention provides a metal golf club head which can produce increased effectiveness and accuracy because of its unique weight distribution. In the subject invention, the design is such that weight is removed from the center sole area and redistributed to concentrations in the heel and toe area. In addition, the design raises the center of gravity of the club head which is believed to create more roll on the ball after impact with the ground and, consequently, more total ball distance results.

In accordance with the subject invention, a golf club head of the general form under consideration comprises an integral hollow metal body with a front striking face, and upper wall, a rear wall, a heel, a toe, a bottom wall forming a sole, and a hosel extends upwardly at a predetermined angle from the heel of the body for attaching the head to a shaft is provided with improved weight distribution. The improved weight distribution results from a recessed cavity formed inwardly of the body throughout an extended area rearwardly of the front striking face and inwardly between the heel and toe such that the ground engaging sole area of the head comprises a front rail portion adjacent the front striking face and side rail portions joined to the front rail portion. The side rail portions extend toward the rear wall adjacent the heel and toe. Preferably, the recessed cavity has a size and depth sufficient to result in a concentration of club head weight in the heel and toe area and to produce an elevation in the center of gravity of the head relative to the ground engaging sole area.

Preferably, and in accordance with a more limited aspect of the invention, the side rail portions extend generally perpendicular to the front striking face and define with the front rail portion a ground engaging section generally U-shaped in plan view.

In accordance with a more limited aspect of the invention, the recessed portion is located centrally of the bottom wall and is generally aligned with the center of the front striking face. Additionally, rail portions preferably have a width in plan view not substantially greater than one-half inch and the recessed cavity has a depth of at least one-quarter inch. By properly arranging and designing the recessed cavity, a significant improvement in the weight distribution and a resulting improvement in club effectiveness results. Additionally, the balance of the club head can be significantly improved.

As can be seen from the foregoing, a primary object of the invention is the provision of a club head wherein the weight of the club is concentrated in the heel and toe areas and the center of gravity of the head is in an elevated position on an axis extending through the middle of the sole and in alignment with the striking face of the club.

A still further object of the invention is the provision of a club head of the type described which can be formed by conventional investment casting techniques from any of a variety of suitable metals.

A still further object of the invention is the provision of a club head of the general type described wherein and improved club head balance results from the use of a recessed sole and peripheral rail members along the heel and toe area joined integrally with a rail extending parallel to and adjacent the striking face.

BRIEF DESCRIPTION OF THE DRAWINGS

The above and other objects and advantages will become apparent from the following description when read in conjunction with the accompanying drawings wherein.

DETAILED DESCRIPTION OF THE PREFERRED EMBODIMENT

Figure 2:
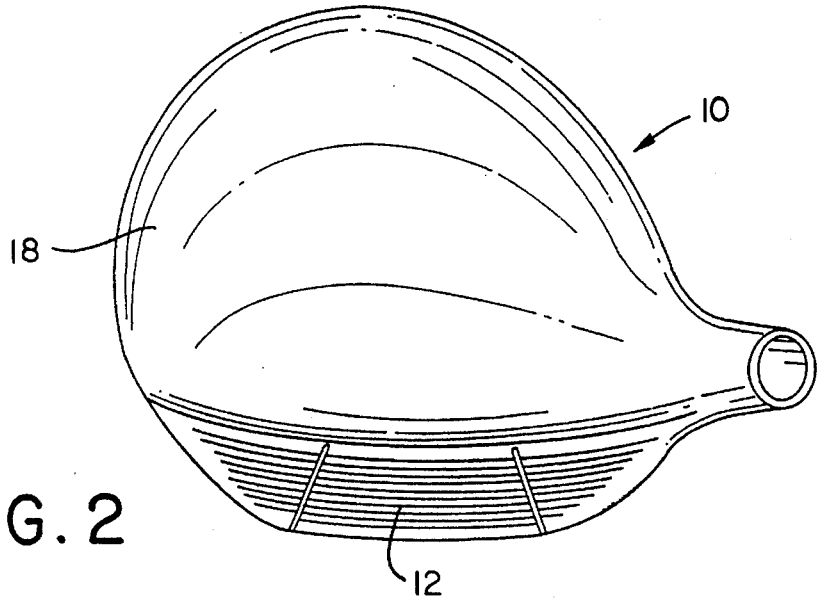
FIG. 2 is a top plan view of the club head shown in FIG. 1.
Figure 1:
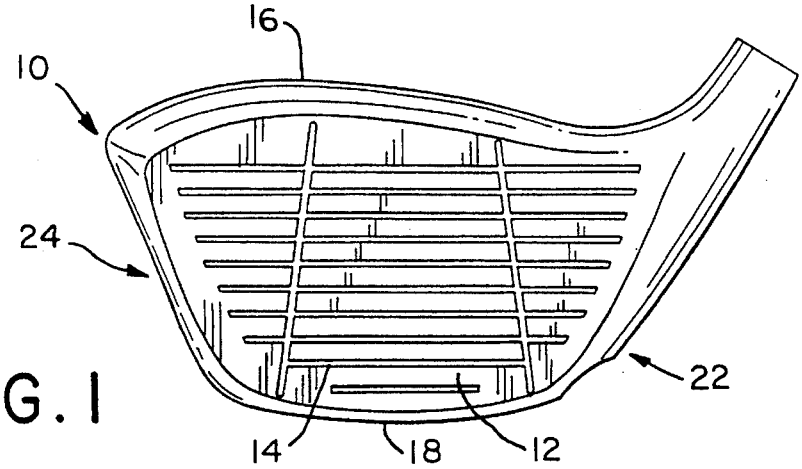
FIG. 1 is a front elevational view of a cast metal wood-type club head incorporating the improved design.
Figure 3:
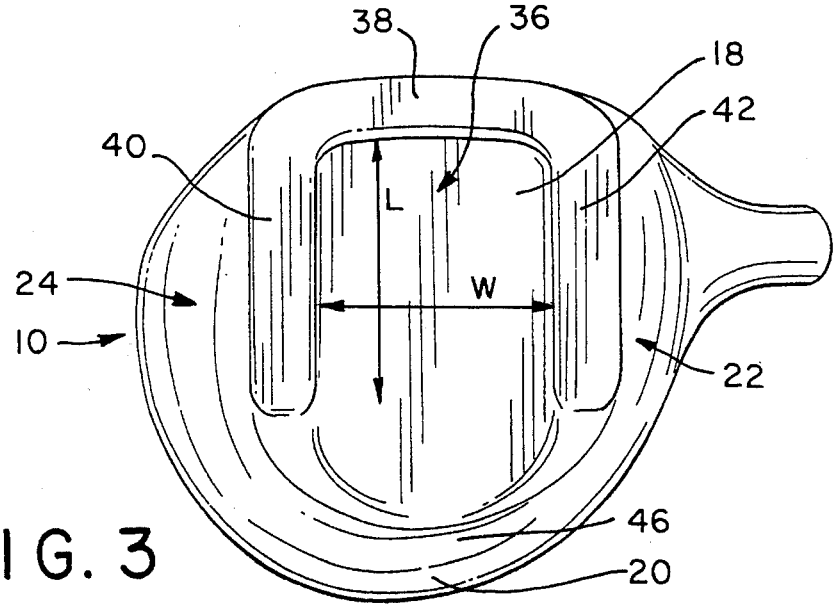
FIG. 3 is a bottom plan view thereof.
Figure 4:
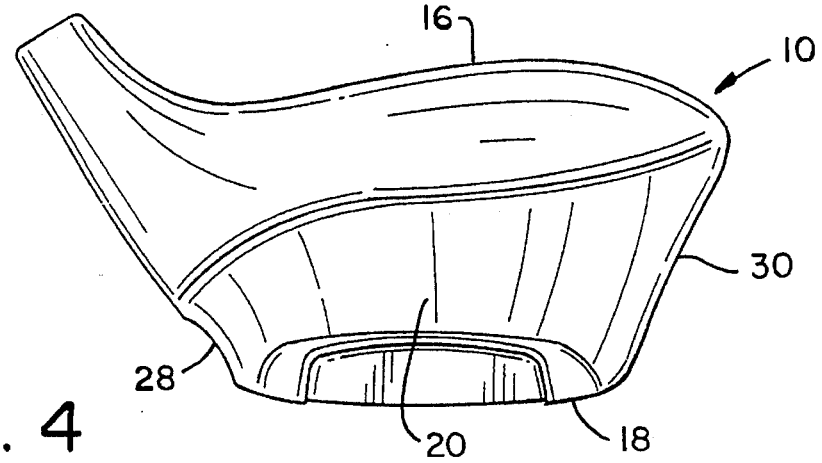
FIG. 4 is a rear elevational view thereof.
Figure 5:
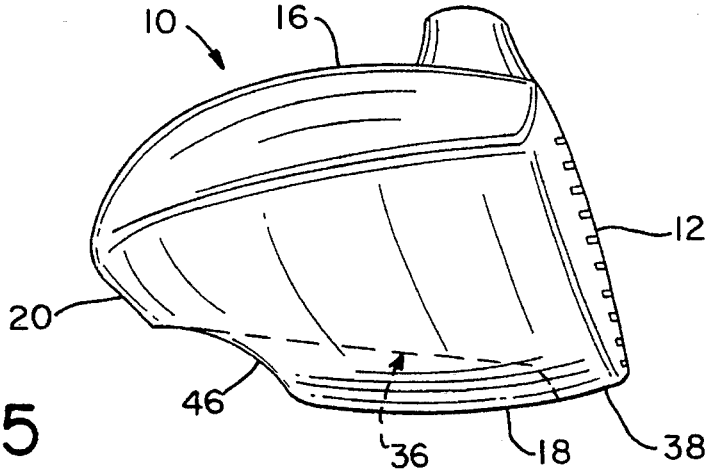
FIG. 5 is an elevational view of the left-hand end of the club of FIG. 1 looking toward the toe of the head; and, FIG. 6 is an elevational view of the right-hand end of the club head shown in FIG. 1 looking toward the heel area of the club.
Figure 6:
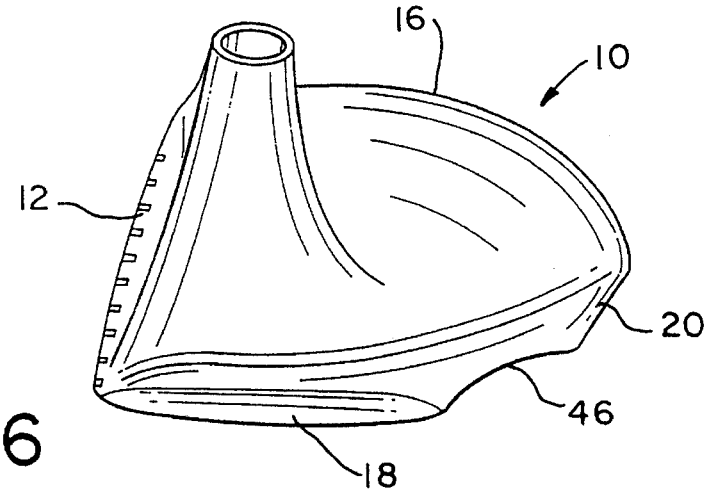

Referring more particularly to FIGS. 1 through 6, the club head of the subject invention is identified generally with the reference numeral 10 and comprises a hollow metal body formed by conventional investment casting techniques from a cobalt-steel alloy identified as F-75 Cobalt. It should be appreciated, however, that many different metals or alloys could be used for forming the head of the invention and, additionally, many different known conventional forming techniques could be used. The club head as illustrated in the drawings is shown in its preferred form and the drawings illustrate the club head in actual, full size depiction. As is customary, the head includes a striking face indicated generally with the reference numeral 12 and inclined rearwardly as best seen in FIG. 5. The striking face 12 is preferably provided with suitable closely spaced grooves 14 which are cast or machined in the face in the arrangement shown. Here, again, however, many different types of grooves or surface treatments could be used to improve the engagement between the striking face and the ball.

The striking face 12 extends between an upper wall 16 and a bottom wall 18. The upper wall 16 is preferably gently contoured as illustrated and connects integrally with a rear wall 20. The rear wall 20 is curved as shown and connects with the front wall or striking face 12 through a heel area 22 and a toe area 24.

In the heel area, the hosel is formed as an integral portion of the body and extends upwardly at the predetermined angle illustrated. This angle can, of course, vary depending upon the club head lie desired and other factors necessary to suit the individual user's desires.

It should be noted that both the heel and the toe areas of the club are somewhat concave in shape as shown at 28 and 30, respectively, in FIG. 4, for example.

The sole area of the club is defined by the bottom wall 18. In this regard, the design of bottom wall 18 is such as to produce the previously described improved weighting and weight distribution in the club head. As illustrated, the bottom wall 18 is provided with an inwardly extending recess 36 which has a width W between the heel and toe areas and a length L extending generally in a direction perpendicular to the striking face 12. Because of the recess 36 extending inwardly of the bottom wall 18 in the manner shown, there results a ground engaging sole area comprised of a front rail portion 38 and side rail portions 40 and 42, respectively (see FIG. 3). Side rail portion 40 is adjacent the toe portion of the head and extends generally perpendicular rearwardly from the striking face 12. The rail portion 42 is also an integral continuation of the front rail portion 38 and runs adjacent the heel 22 of the head 10. Preferably, each of the rail portions 38, 40, and 42 have a width which is at least about one-half inch in width and has a height relative to the bottom of the recess in the range of from one-quarter to one-half inch.

The general configuration for the recess 36 is shown in FIG. 5 and, in the preferred embodiment, extends from a depth of approximately three hundred thousandths of an inch adjacent the front rail portion 38 to a maximum depth of approximately four hundred thousandths of an inch adjacent the rear of the side rails 40, 42. To further increase the distribution of the weight in an upward direction, the club head is provided with the concave toe and heel portions 20, 30 previously mentioned as well as the recess 46 which is shown at the lower portion of the rear wall 20 and best illustrated in FIGS. 5 and 6. This arrangement thus far described shifts the weight of the club head from the traditional spot in the center of the club to a location outwardly in the area of the outer side rail portions. In the club head illustrated, the side rail portions are spaced apart a distance of approximately one and one-quarter inches, and they have a length of approximately one and one-half inches.

As mentioned earlier, the preferred embodiment of the club head of the subject invention is formed using conventional investment casting techniques. When manufactured from the previously mentioned F-75 Cobalt alloy, the head as shown in the drawings has a weight of approximately 200 to 215 grams. In addition, the head is formed to be a hollow shell with the striking face having a thickness in the range of 0.125 to 0.136 inches and the sole plate area including the side rails being of about 0.040 to 050 inches in thickness. The remaining portions of the head are about 0.025 to 0.035 inches in thickness.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described the invention, it is now claimed:

1. In a golf club head comprising an integral hollow metal body having a front striking face, an upper wall, a rear wall, a heel, a toe, a bottom wall forming a sole, and a hosel extending upwardly at a predetermined angle from the heel of the body for attaching the head to a shaft, the improvement wherein the bottom wall includes a recessed cavity inwardly of the body throughout an extended area which lies rearwardly of the front striking face and inwardly of the heel and toe such that the ground engaging sole area of the head comprises a front rail portion adjacent the front striking face and side rail portions joined to the front rail portion and extending toward the rear wall adjacent the heel and the toe, the recessed cavity having a generally rectangular shape in plan view and having a size and depth sufficient to result in a concentration of club head weight in the heel and toe area and produce an elevation in the center of gravity of the head relative to the ground engaging sole area, said side rail portion and said recessed cavity forming a generally rectangular opening adjacent said rear wall.

2. The golf club head according to claim 1 wherein the side rail portions extend generally perpendicular to the front striking face.

3. The golf club head according to claim 1 wherein the recessed cavity has a depth of at least 0.25 inches.

4. The golf club head according to claim 1 wherein the side rail portions have a width in plan view not substantially greater than 0.5 inches.

5. The golf club head according to claim 4 wherein said recessed portion is located centrally of the bottom wall and generally aligned with the center of the front striking face.

6. The golf club head according to claim 5 wherein the heel and the toe are recessed inwardly generally from the bottom wall toward the upper wall.

* * * * *